US006832692B2

(12) United States Patent
Ryall et al.

(10) Patent No.: US 6,832,692 B2
(45) Date of Patent: Dec. 21, 2004

(54) CLOSURE INSERT

(75) Inventors: Graham Ryall, Oxfordshire (GB); Keith West, Oxfordshire (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 295 days.

(21) Appl. No.: 10/240,152

(22) PCT Filed: May 9, 2001

(86) PCT No.: PCT/GB01/02008

§ 371 (c)(1),
(2), (4) Date: Sep. 30, 2002

(87) PCT Pub. No.: WO01/87726

PCT Pub. Date: Nov. 22, 2001

(65) Prior Publication Data

US 2003/0102281 A1 Jun. 5, 2003

(30) Foreign Application Priority Data

May 16, 2000 (EP) ..... 00304104

(51) Int. Cl.[7] ..... B65D 41/22
(52) U.S. Cl. ..... 215/318; 215/341

(58) Field of Search ..... 215/317, 318, 215/252, 341, 347

(56) References Cited

U.S. PATENT DOCUMENTS 4,603,786 A * 8/1986 Lecinski et al. ..... 215/318
4,709,825 A * 12/1987 Mumford ..... 215/318
4,863,030 A * 9/1989 Bayer et al. ..... 206/427

* cited by examiner

*Primary Examiner*—Jacob K. Ackun, Jr.
(74) *Attorney, Agent, or Firm*—Diller, Ramik & Wight

(57) ABSTRACT

An insert (1) for a closure provides, in a single component, a gasket function between the end panel (12) of the closure and the end sealing surface (22) of a container neck finish (20), a thread forming feature (3) and a tamper evident band (5). The sealing portion (gasket (2) and thread forming feature (3)) of the insert is formed from soft pliant material so as to provide excellent sealing. The tamper evident band (5) is made from much stiffer material than that of the sealing portion, thereby providing rigidity to the entire component. During assembly the integral tamper evident band (5) thus maintains the insert in a circular and non-twisted shape, ensuring ease of handling of the insert.

13 Claims, 1 Drawing Sheet

CLOSURE INSERT

BACKGROUND OF THE INVENTION

This invention relates to inserts for closures of the press-on/twist-off type which have a tamper evident band.

Press-on/twist-off closures are caps which not only are applied to and removed from a container by press-on and twist-off actions respectively but which also comprise a tamper-evident band. Such closures are sometimes known commercially as PT+ (trade mark) closures.

Press-on/twist-off (PT) closures are well known in which the closure has an insert formed from a foamed plastisol material. PT+ closures have been described, for example, in EP-0450959 in which the closure comprises a metal body lined with a plastisol gasket and having a tamper-evident band (also known as a "security ring").

In WO 98/52833, a press-on/twist-off closure is described which uses a pre-formed insert in place of the former plastisol material. Instead of moulding the insert in the closure shell, as with a foamed plastisol material, the insert of WO 98/52833 can be formed separately by injection moulding, for example, and then secured in the shell by a curl on the edge of the shell.

The insert of WO 98/52833 is formed from a relatively soft material such as certain grades of polypropylene, polypropylene/nylon blends or thermoplastic elastomers. Soft liners provide excellent sealing since they readily conform to irregularities in the sealing surface and threads in the finish of a glass container to which the closure is applied. However, problems arise when applying the closure since the insert may flex if the press-on capping action is not applied in a truly horizontal position. This problem can be further exacerbated if a tamper evident band is to be used in conjunction with the soft insert, as the liner is free to move in the metal shell when the tamper evident band is applied. This can lead to rotation and/or tilt of the insert.

A further problem exhibited by the insert of WO 98/52833 is the difficulty in handling a flexible component at commercial line speeds in current cap manufacturing apparatus. Twisting of the component into loops and asymmetric shapes is typical in addition to problems of presenting the insert to the closure shell in the correct orientation.

SUMMARY OF THE INVENTION

This invention seeks to provide a pre-formed insert for a closure which overcomes these problems.

According to the present invention, there is provided a pre-formed moulded insert having a first portion formed of a polymeric material having a Shore hardness in the range of 30 Shore A to 45 Shore D, and a second portion comprising a tamper evident band integrally formed with the first portion and formed of a polyolefin material.

Typically, the material of the second portion has a flexural modulus greater than 1200.

In a further aspect of the present invention, there is provided a closure of the press-on/twist-off type comprising a shell including a skirt and an end panel, and a pre-formed insert of the type described above, in which the first portion is adapted to perform liner and sealing functions in the closure, in which the insert is secured in position with the first portion within the closure such that the tamper evident band depends from the closure shell.

For sealing a container, the thread finish on the container may form complementary threads on the inner side wall of the insert when the closure is applied to the container and the gasket part of the insert provides sealing between the end panel of the closure and the end sealing surface of a neck finish. The insert of the present invention thus provides (i) a gasket function, (ii) a thread forming feature and (iii) a tamper evident band, in a single component.

By using an insert which includes an integral tamper evident band prior to assembly in the metal shell, risk of tilting or rotation of the sealing/liner portion is eliminated. The unitary construction of the insert of the present invention means that there is only ever a single component to be secured in position.

The insert may be secured in position within the shell by curling the edge of the metal shell into or around part of the insert, thermal or other bonding, or by other mechanical means of engagement.

In a preferred embodiment, the tamper evident band portion comprises a material having a flexural modulus of between 1200 and 1600 MPa. By using a stiffer material for the tamper evident ring portion of the insert, rigidity is provided to the whole insert. This in turn makes the insert easier to handle by maintaining it in a circular (rather than twisted) shape, easier to position within the closure shell and, when inserted in the closure shell, easier to apply to a container in the required horizontal position.

The insert may be formed by sequential (two colour/two material) moulding of a plastic component from two portions having properties selected according to the portion of the insert for which the material is intended. Usually the material of the second portion may be polypropylene or polypropylene-based. Conventionally polymers such as polypropylene is characterised by its modulus.

The material of the first portion may be a polypropylene blend including materials such as butyl rubber, nitrile rubber, EPDM, ethyl vinyl, polyurethanes, acrylic polymers, polyethylenes and copolymers, or nylons. Conventionally, such elastomers are defined by their Shore hardness. The choice of material used for the first portion depends on the ability to mould a single component from two materials with different Shore hardness/flexural moduli according to the function to be performed.

Preferred embodiments of the invention will now be described, by way of example only, with reference to the drawings in which:

DESCRIPTION OF THE PREFERRED EMBODIMENTS

Figure 1:
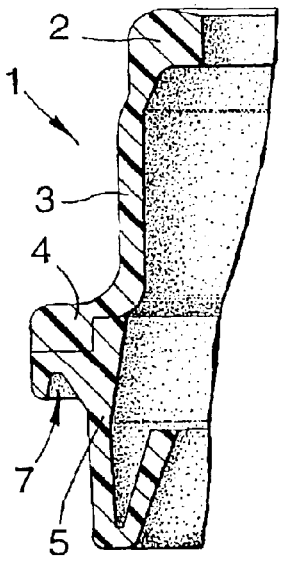
FIG. 1 is a schematic sectional view of an insert of the present invention.

Referring to FIG. 1, a pre-formed insert is shown generally at 1, and comprises a first portion having a sealing part 2 and a thread retention part 3, a securing rim 4 and a tamper evident band 5. The insert is typically formed by sequential injection moulding of the tamper evident band 5 and then the sealing/thread retention portion, or vice versa.

The material of the sealing/thread retention portion is selected for its ability to retain the impression of the thread on a glass container, and for optimum sealing. The Applicant has found that whilst materials having a Shore D hardness of up to 90 are, in theory, suitable, there is an incidence of "slow leakers" which reduces considerably with the hardness. However, handling of materials having a low Shore D hardness of less than, say, 80 is much more difficult at commercial line speeds.

Nonetheless, in the present invention, the material of the second or tamper evident band portion 5 of insert 1 is much stiffer than that of the sealing/thread retention portion and so provides a degree of rigidity to the insert 1. Typically the tamper evident band portion has a flexural modulus of 1200 to 1600. For optimum sealing, the modulus of the sealing/thread retention portion is from 5 to 100. In contrast with the insert of WO 98/52833, the insert 1 combines both stiff and pliable materials in a single component, is easy to handle, does not deform during application to a container shell and provides excellent sealing.

Figure 2:
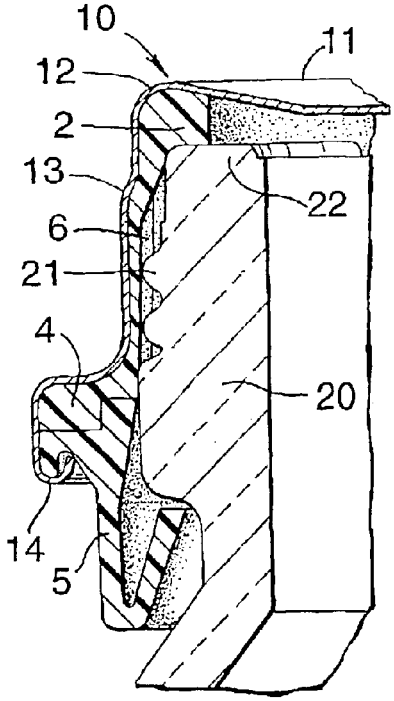
FIG. 2 is a schematic sectional view of the insert of FIG. 1 in a first embodiment of tamper evident vacuum closure.
Figure 3:
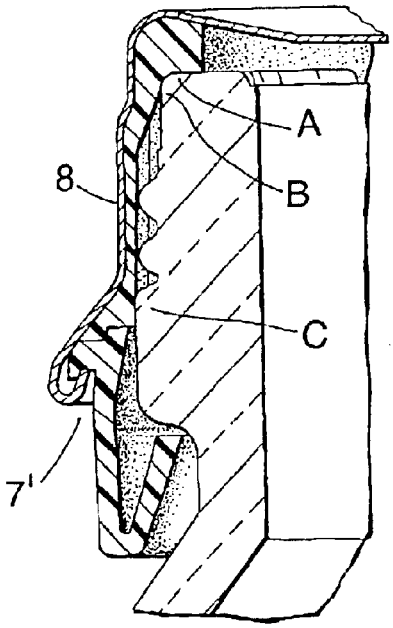
FIG. 3 is a schematic sectional view of the insert of FIG. 1 in a second embodiment of tamper evident vacuum closure.

Two embodiments of PT+ vacuum closure 10 using the insert of the present invention are shown applied to the neck finish 20 of a container such as a glass jar in FIGS. 2 and 3. The closure has a metal shell 11, including an end panel 12 and a downwardly dependent skirt 13. The first portion, comprising sealing and thread forming parts 2, 3 of polypropylene insert 1 is received within the shell 11, with tamper evident band portion 5 depending from the rim of the shell.

In the embodiment of FIG. 2, the insert 1 is applied to the shell 11, and the skirt 13 is curled over to form an inwardly facing curl 14. The curl 14 traps the sealing rim 4 and secures the insert 1 within the shell. Ideally, as shown, the edge of the curl 14 is retained within a groove 7 in the tamper evident band portion 5. Alternatively, the curl may simply embed itself in the insert material.

The insert of the embodiment of FIG. 3 is heat sealed into the shell 11 as shown at 8. Clearly other forms of bonding are also possible within the scope of the invention. The insert of FIG. 3 may also include a groove 7' so that the exposed edge of the metal shell 11 is curled and trapped in the insert, thus increasing the mechanical lock and avoiding exposure to the atmosphere.

The neck finish 20 of the container includes thread formations 21 and an end sealing surface 22. When the vacuum closure is applied to the neck finish in a conventional manner, the sealing part 2 of the insert 1 forms an hermetic seal between the end panel 12 and the end sealing surface 22 of the container at Area 'A' (see FIG. 3). Typically a side seal is also formed between a region of the insert and the neck finish at Area 'B'. Similarly, a lower region of the insert 1 co-operates with the side wall of the neck finish at Area 'C', in order to provide a barrier to the ingress of foreign bodies such as dust, dirt and insects etc.

The thread retention part 3 of the insert is deformed by the thread formations 21 on the neck finish so that the vacuum closure 10 can be removed from the container by the user in a "twist-off" manner. The thread retaining portion 3 of the insert 1 remains at least partially deformed by the thread formations 21, so that the closure can be reapplied to the glass jar by twisting it back on to the neck finish.

In the embodiments shown in FIGS. 2 and 3, the insert 1 is provided with pre-formed longitudinally extending ribs 6. The ribs are typically 0.35 mm in radial depth as compared to an overall insert radial thickness of 0.6 mm. The thread formations 21 make indentations in the ribs 6 which allow the closure to be easily reapplied to the container, whilst ensuring that the initial opening torque necessary to remove the closure from the container is not excessive and typically in the range 10–30 Kgf-cm. The ribs 6 also act as a cushion, so as to improve the abuse resistance of the closure. Other forms of projections, such as pimples etc. (not shown) could also be employed to retain the impression of the thread formations 21 and so as to ensure that the closure 'ramps off' when twisted.

The tamper evident band includes a line of weakness (not shown) which fractures when the closure is removed from the container. Ideally, this is formed by cutting into the tamper evident band portion of the insert after it has been fitted to a closure. The line of weakening may be made in any known manner, for example as disclosed in EP-0784575.

Although a preferred embodiment of the invention has been specifically illustrated and described herein, it is to be understood that minor variations may be made in the apparatus without departing from the spirit and scope of the invention, as defined by the appended claims.

What is claimed is:

1. A pre-formed moulded insert having a first portion formed of a polymeric material having a Shore hardness in the range of 30 Shore A to 45 Shore D, and a second portion comprising a tamper evident band integrally formed with the first portion and formed of a polyolefin material.

2. An insert according to claim 1, in which the second portion comprises a material having a flexural modulus of between 1200 and 1600 MPa.

3. An insert according to claim 1, which is formed by sequential moulding.

4. An insert according to claim 2, which is formed by sequential moulding.

5. A closure of the press-on/twist-off type comprising a shell including a skirt and an end panel, and a preformed insert according to claim 1, in which the first portion is adapted to perform liner and sealing functions in the closure, and the insert is secured in position with the first portion within the closure such that the tamper evident band depends from the closure shell.

6. A closure according to claim 5, in which the thread finish on a container forms complementary threads on the insert when the closure is applied to the container.

7. A closure according to claim 5, in which the insert is secured in position within the shell by mechanical engagement.

8. A closure according to claim 7, in which the mechanical engagement is curling the edge of the metal shell into or around part of the insert.

9. A closure according to claim 7, in which the mechanical engagement is thermal or other bonding.

10. A closure according to claim 6, in which the insert is secured in position within the shell by mechanical engagement.

11. A closure according to claim 8, in which the mechanical engagement is thermal or other bonding.

12. A closure of the press-on/twist-off type comprising a shell including a skirt and an end panel, and a pre-formed insert according to claim 2, in which the first portion is adapted to perform liner and sealing functions in the closure, and the insert is secured in position with the first portion within the closure such that the tamper evident band depends from the closure shell.

13. A closure of the press-on/twist-off type comprising a shell including a skirt and an end panel, and a pre-formed insert according to claim 3, in which the first portion is adapted to perform liner and sealing functions in the closure, and the insert is secured in position with the first portion within the closure such that the tamper evident band depends from the closure shell.

* * * * *